United States Patent [19]

Hanyu et al.

[11] 4,401,042

[45] Aug. 30, 1983

[54] ELECTRONIC CONTROL SEWING MACHINE

[75] Inventors: Susumu Hanyu; Kenji Kato, both of Hachioji, Japan

[73] Assignee: Janome Sewing Machine Co., Ltd., Tokyo, Japan

[21] Appl. No.: 245,671

[22] Filed: Mar. 19, 1981

[30] Foreign Application Priority Data

Mar. 25, 1980 [JP] Japan ..... 55-36844

[51] Int. Cl.[3] ..... D05B 3/02; D05B 69/18

[52] U.S. Cl. ..... 112/158 E; 112/277

[58] Field of Search ..... 112/158 E, 158 R, 220, 112/221, 275, 277

[56] References Cited

U.S. PATENT DOCUMENTS 4,078,506 3/1978 Sasaki ..... 112/277 X 4,262,614 4/1981 Sugaya et al. ..... 112/158 E

*Primary Examiner*—Peter P. Nerbun

*Attorney, Agent, or Firm*—Michael J. Striker

[57] ABSTRACT

In a sewing machine having a machine controller for controlling the rotational speed of the machine and a needle amplitude, adjusting device, a machine control power source switch is provided which is manipulated to produce a switch-over signal, which is identified in a predetermined lapse of time to avoid an erroneous operation of the sewing machine which may be caused by a simple switching operation of the power source switch. The power source switch is released to return to the initial position and is operated again to switch back the machine controller to the function controlling the rotation speed of the sewing machine. The change-over circuit with transmission gates is provided in the sewing machine, which is electrically connected to the amplitude adjusting device and the machine controller and to the control power source switch, respectively.

4 Claims, 5 Drawing Figures

① Start
② Change of mode
③ Change of indication
④ A - mode
⑤ Speed control by VR1
⑥ Amplitude adjustment by VR2
⑦ Speed control by VR2
⑧ Amplitude adjustment by VR1

ELECTRONIC CONTROL SEWING MACHINE

BRIEF DESCRIPTION OF THE INVENTION

The invention relates to an electronic control sewing machine, and more particularly relates to an operation mode changing system of the sewing machine, in which a machine controller, which is normally manipulated to control the rotation speed of the sewing machine, is switched to control the lateral swinging amplitude of the needle.

The conventional sewing machine has a knob or dial arranged on the front face thereof to be manipulated to adjust the lateral swinging amplitude of the needle. However, in order to freely and effectively control the needle amplitude during a stitching operation such as the embroidering stitching operation or other optional pattern stitching operations, it is generally required to provide the sewing machine with another operating part such as a lever suitable for manual operation to this stitching object. In the recently developed multi-functioned sewing machine such as the electronic control sewing machine, it is actually difficult to provide such an additional operating part on the front face of the sewing machine due to the problem of mounting space and the problem of structure to connect the operating part to the electronic elements printedly arranged within the sewing machine. The copending Japanese patent application No. 54-123134 discloses a technique to switch over the machine speed controller to control the needle swinging amplitude, instead of using an additional operating part. Even in this case, there is a problem to arrange a specific change-over switch in the limited space of the sewing machine.

The invention has been provided to eliminate the difficulties and problems of the prior art. According to the invention, a machine control power source switch is manipulated to produce a switch-over signal, which is identified in a predetermined lapse of time to avoid an erroneous operation of the sewing machine which may be caused by a simple switching operation of the power source switch. The power source switch is released to return to the initial position and is operated again to switch back the machine controller to the function controlling the rotation speed of the sewing machine. The change-over circuit is provided with transmission gates for electronically and exactly attaining this switching object.

BRIEF DESCRIPTION OF THE ATTACHED DRAWINGS

DETAILED DESCRIPTION OF THE INVENTION

Figure 1:
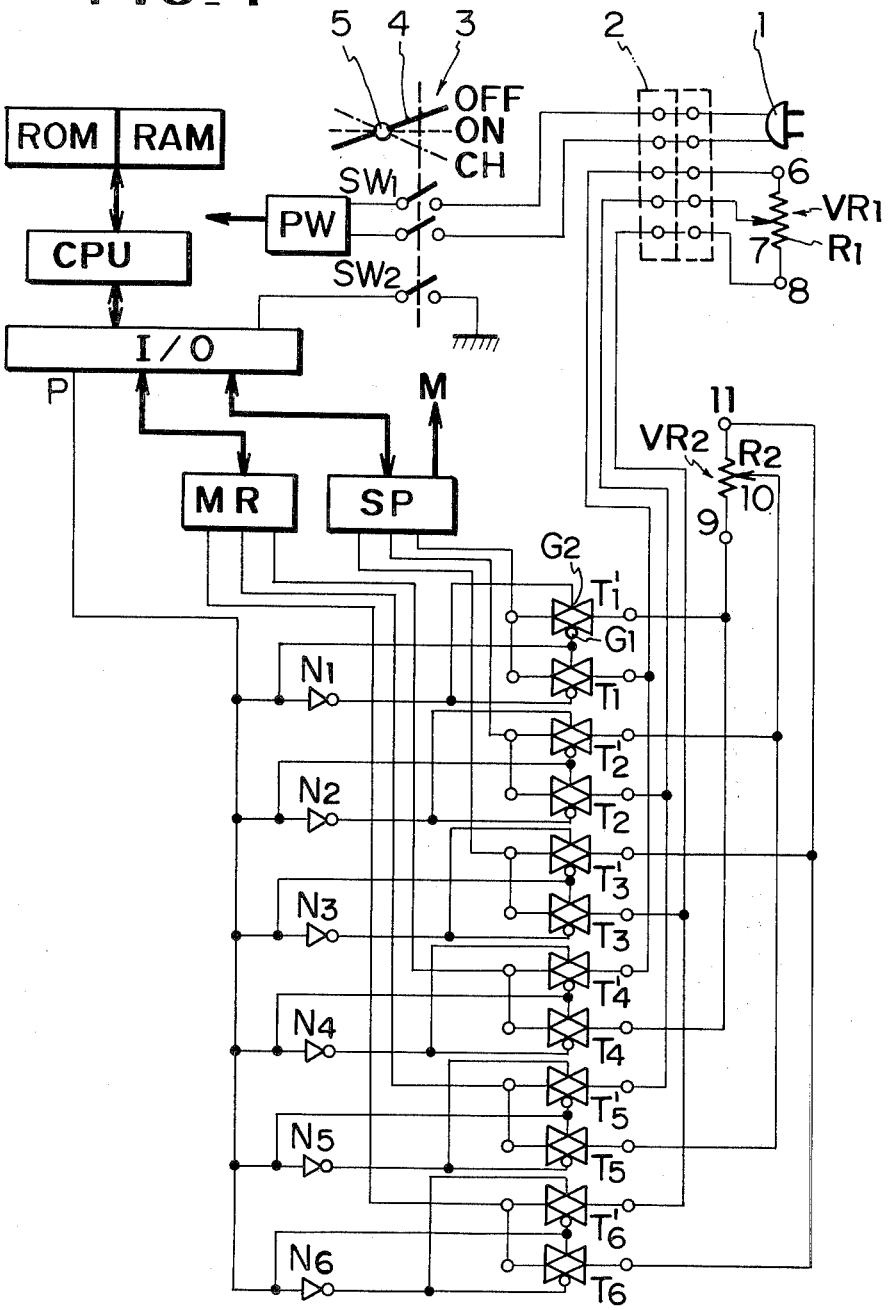
FIG. 1 is a diagramatic control circuit of the invention.

In reference to FIG. 1, a plug 1 is connected to a commercially available power source, and is connected to a connection plug 2. A switch device 3 has an operating element 4 which is moved around a pivot 5 to a first position OFF where the power source is cut off, to a second position ON where the power source is supplied and to a third position CH where the operation mode of a machine controller is changed. Namely the switch device 3 positioned at the first position opens a power source switch $SW_1$ and an operation mode changing switch $SW_2$. The switch device 3 is moved to the second position ON to close the power source switch $S_1$, and is moved to the third position CH to close the operation mode changing switch $SW_2$. When released, the switch device 3 is returned to the second position, so that the operation mode changing switch $SW_2$ may be normally opened.

A control power source PW is connected to the power source plug 1 as shown. A read only memory ROM stores a number of stitch control signals and program control signals. A central process unit CPU uses the program control signals to perform the program controls. A random access memory RAM temporarily memorizes the processes and results of the performed programs, and an input and output port I/O is provided. These elements ROM, CPU, RAM and I/O constitute a microcomputer.

The operation mode changing switch $SW_2$ is closed to give a low level signal to the central process unit CPU through the input and output port I/O. A machine controller $VR_1$, which is manually operated, for example, by foot, is normally used to control the rotation speed of the machine drive motor. The machine controller $VR_1$ is designed to be switched to control the amplitude of the needle (lateral swinging movement of the needle) in this invention. The variable resistor $R_1$ has one end 6 connected to the ends of transmission gates $T_1$, $T'_4$ and has the other end 8 connected to the ends of transmission gates $T_3$, $T'_6$ and the wiper 7 is connected to the ends of transmission gates $T_2$, $T'_4$. An adjuster device $VR_2$ is mounted on the front face of the sewing machine and is normally used to control the amplitude of the needle (lateral swinging movement of the needle). The adjuster device $VR_2$ is designed to be switched to control the speed control of the machine drive motor. The variable resistor $R_2$ has one end 9 connected to the ends of transmission gates $T'_1$, $T_4$, and has the other end 11 connected to the ends of transmission gates $T'_3$, $T_6$, and the wiper 10 is connected to the ends of transmission gates $T'_3$, $T_5$.

The speed control circuit SP is connected to the central process unit CPU to give and receive the speed control signals to and from the latter, and is also connected to the opposite ends of the transmission gates $T_1$, $T_2$, $T_3$. If these transmission gates are conductive, the speed control circuit SP is connected to the machine controller $VR_1$. The speed control circuit SP is also connected to the opposite ends of the transmission gates $T'_1$, $T'_2$, $T'_3$. If these transmission gates are conductive, the speed control circuit SP is connected to the adjuster device $VR_2$. An amplitude adjusting circuit MR is connected to the central process unit CPU to give and receive the amplitude adjusting signals to and from the latter, and is also connected to the opposite ends of the transmission gates $T'_4$, $T'_5$, $T'_6$. These transmission gates are made conductive to connect the amplitude adjusting circuit to the machine controller $VR_1$. The amplitude adjusting circuit MR is also connected to the opposite ends of the transmission gates $T_4$, $T_5$, $T_6$, and these transmission gates are made conductive to connect the amplitude adjusting circuit MR to the amplitude adjusting device $VR_2$.

The output of the speed control circuit SP is applied to the machine drive motor M. The input and output port I/O has an output terminal P of operation mode changing signal connected directly or through inverters $N_1$–$N_6$ to the gates $G_1$, $G_2$ of the transmission gates $T_1$–$T_6$, $T'_1$, $T'_6$ as shown. If the potential of the output terminal P is high level, the transmission gates $T_1$–$T_6$ become conductive and the transmission gates $T'_1$, $T'_6$ become nonconductive. On the other hand, if the potential is low level, the state of the transmission gates is reversed. Therefore, if the potential of the output terminal P is high level, the variable resistor $R_1$ is connected to the speed control circuit SP, and the variable circuit $R_4$ is connected to the amplitude adjusting circuit MR. On the other hand, if the potential is low level, the variable resistor $R_1$ is connected to the amplitude adjusting circuit MR and the variable resistor $R_2$ is connected to the speed control circuit SP.

Figure 2:
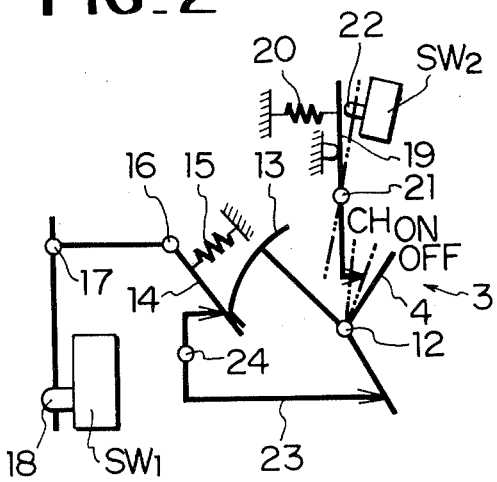
FIG. 2 is a first embodiment of switch device of the invention.

In reference to FIG. 2 showing a first embodiment of the switch device 3 of the invention, when the operating element 4, which is turnable around a pivot 12, is in the first position OFF as shown by the solid line among the predetermined positions it may take, an actuating rod 13 gives no influence to a lever 14 which is turnable around a fixed pivot 16 and is normally biased by a spring 15 in the counterclockwise direction to the most extent. The lever 14 displaces the actuator 18 of the power source switch $SW_1$ downwardly thereof to open the switch $SW_1$ by way of a movable pivot 17 to thereby open the switch $SW_1$. Also in this state, the operating element 4 gives no influence to another lever 19 which is turnable around a pivot 21 and is normally biased by a spring 20 in the counterclockwise direction. The lever 19 is therefore spaced from the actuator 22 of the operation mode changing switch $SW_2$ to open the switch $SW_2$.

When the operating element 4 of the switch device 3 is brought to the second position ON as shown by the broken line, the actuating rod 13 turns the lever 14 in the clockwise direction against the action of the spring 15. As a result, the actuator 18 of the power source switch $SW_1$ is displaced to an upper position, and the switch $SW_1$ is turned on and this state is maintained. However in this state, the operating element 4 is designed to give no influence to the lever 19. When the operating element 4 of the switch device 3 is brought to the third position CH as shown by the broken line, the operating element 4 turns the lever 19 in the clockwise direction against the action of the spring 20. As a result, the lever 19 pushes the actuator 22 to close the operation mode changing switch $SW_2$. In this state, the operating element 4 is designed to give no influence further to the actuator 18 of the power source switch $SW_1$. Then if the operating element 4 is released, it is automatically returned to the second position ON, and at the same time, the lever 19 is turned in the counterclockwise direction by the action of the spring 20. As a result, the operation mode changing switch $SW_2$ is opened. Another lever 23, which is turnable on a pivot 24, is operated in association with the operating element 4 to turn the lever 14 in the counterclockwise direction to thereby downwardly displace the actuator 18 of the power source switch $SW_1$ to open the latter when the operating element 4 is brought to the first position OFF from the second position ON.

Figure 3:
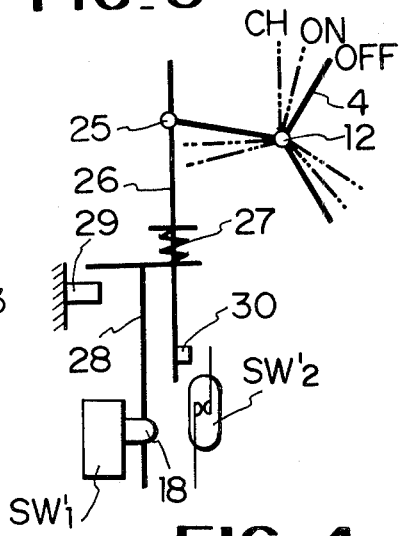
FIG. 3 is a second embodiment of switch device of the invention.

In reference to FIG. 3 showing a second embodiment of the switch device 3, if the operating element 4 is brought to the second position ON from the first position OFF, a vertical link 26 is downwardly displaced by way of a movable pivot 25. Then a vertical rod 28 connected to the link 26 through a spring 27 is depressed and displaces the actuator 18 downwardly of the power source switch $SW_1$ to close the latter. When the operating element 4 is brought to the third position CH, the vertical rod 26 is further depressed and a magnet 30 at the lower end of the rod 26 closes a lead switch $SW'_2$ corresponding to the operation mode changing switch $SW_2$ in FIG. 2 while the vertical rod 28 is prevented from further downward movement by a stopper 29 and maintains the power source switch $SW_1$ as it is closed. In this state, if the operating element 4 is released, it is automatically returned to the second position ON, and the vertical rod 26 is returned by the action of the spring 27 to an upper position where the magnet 30 opens the lead switch $SW'_2$. Since the spring 27 is at the lower end thereof connected to the rod 28, if the operation element 4 is brought to the first position OFF from the second position ON, the vertical rod 28 is displaced in the upper position and opens the power source switch $SW_1$.

Figure 4:
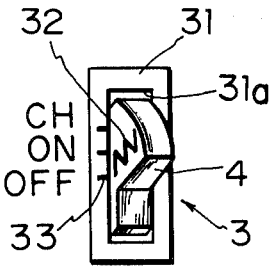
FIG. 4 is an outlined representation of the switch device.

As shown in FIG. 4, the operating element 4 of the switch 3 is provided on a suitable place of a sewing machine such as on one side thereof so that the operating element 4 may be freely accessible by a machine operator. The operating element 4 is turnably mounted on the pivot 12 in the machine housing 31 and is partly projected out of the cutout 31*a*. The cutout 31*a* has three indices 33 provided on one side thereof representing the first, second and third positions OFF, ON, CH to be taken by the operating element 4. The operating element 4 has three offset indices 32 each to be in alignment with each of the indices 33 on the machine housing by operation of the element 4 so that the latter may take the three positions selectively and exactly.

Figure 5:
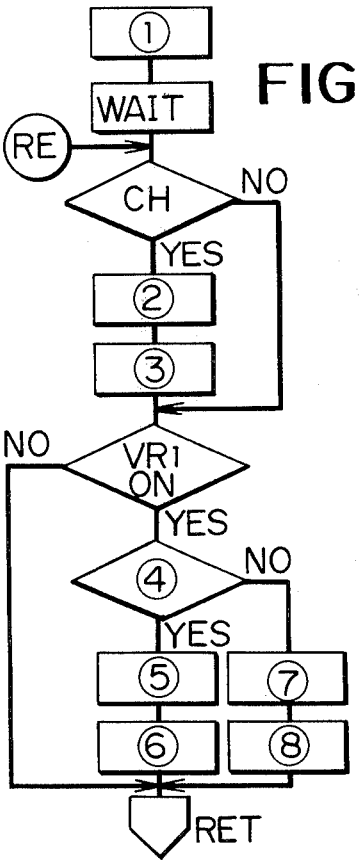
FIG. 5 is a flow chart showing the control operation of the invention.

In reference to FIG. 5 showing the flow chart for explanation of the operation of this invention; If the switch device 3 is brought to the second position ON from the first position OFF, the power source switch $SW_1$ is closed and the central process unit CPU starts to make a program control. Namely in a predetermined lapse of time WAIT after the power source switch $SW_1$ is closed, it is discriminated if the switch device 3 has been brought to the third position CH. This predetermined lapse of time is provided in such a sense that the erroneous operation of the switch device 3 may not be detected in the program. Namely in case the switch device 3 is brought to the third position by error in the course of displacement of the switch device 3 from the first to the second position, the third position CH is not detected if the switch device 3 is instantly released. If the switch device 3 is not at the third position, the central process unit CPU produces a high level signal at the terminal P. Then the transmission gates $T_1$–$T_6$ become conductive and the transmission gates $T'_1$–$T'_6$ become nonconductive. As a result, the speed control circuit SP is connected to the machine controller $VR_1$ and the amplitude adjusting circuit MR is connected to the amplitude adjusting device $VR_2$. This may be called A-MODE and is separately indicated, and simultaneously the high level at the terminal P (A-MODE) is discriminated. Thus it becomes possible to control the rotation speed of the machine drive motor by manipulation of the machine controller $VR_1$, and also to adjust the needle swinging amplitude by manipulation of the amplitude adjusting device $VR_2$.

If the switch device 3 is brought to the third position CH, the operation mode changing switch $SW_2$ is closed and produces a low level signal which is detected by the central process unit CPU, and the terminal P of the CPU becomes a low level. Then the transmission gates $T_1$–$T_6$ becomes nonconductive and the transmission gates $T'_1$–$T'_6$ become conductive. Thus the speed control circuit SP is connected to the amplitude adjusting device $VR_2$, and the amplitude adjusting circuit MR is connected to the machine controller $VR_1$. This may be called B-MODE and is so indicated. As a result, it becomes possible to adjust the needle swinging amplitude by manipulation of the machine controller $VR_1$, and to control the rotation speed of the machine motor M by manipulation of the amplitude adjusting device $VR_2$. In this case, if it is necessary to control the rotation speed of the machine motor M by manipulation of the amplitude adjusting device $VR_2$, the amplitude adjusting device $VR_2$ may be fixed to make a constant speed control of the machine drive motor M. Subsequently if the switch device 3 is brought to the third position CH again, the same mode of operation is repeated from the point RE through the repetition point RET.

I claim:

1. A sewing machine having a machine drive motor, stitch forming means driven by the machine drive motor to change the relative positions of a sewn fabric and a needle which is vertically and laterally reciprocated, a machine controller operated to control the rotation speed of the machine drive motor, and an amplitude adjusting device operated to adjust the lateral swinging amplitude of the needle, said sewing machine comprising a power source, a speed control circuit electrically connected to the machine controller by the power source, an amplitude adjusting circuit electrically connected to the amplitude adjusting device by the power source, switch means operated to take a first position in which the switch means opens the power source to make inoperative the machine controller and the amplitude adjusting device, a second position in which the switch means closes the power source to make operative the machine controller and the amplitude adjusting device, and a third position in which the switch means produces an operation mode changing signal, means for detecting a predetermined lapse of time after the switch means take the third position, means for identifying the predetermined lapse of time, and means receiving the operation mode changing signal after the identification of the predetermined lapse of time to electrically connect the amplitude adjusting circuit to the machine controller.

2. A sewing machine as defined in claim 1, wherein said switch means taking the third position is released to automatically return to the second position.

3. A sewing machine as defined in claim 1, wherein said means receiving the operation mode changing signal connects the speed control circuit to the amplitude adjusting device.

4. In a sewing machine, a combination comprising a motor; stitch forming means driven by the motor to change their relative positions to a sewn fabric and a needle which is vertically and laterally reciprocable; a machine controller to control the rotational speed of the machine; an amplitude adjusting device for adjusting the lateral swing amplitude of the needle; a power source; and means for selectively activating and deactivating the machine controller and the amplitude adjusting device for joint operation, and respectively for joint disengagement, said activating and deactivating means including switch means operated to take a first position in which the switch means opens the power source to make inoperative the machine controller and the amplitude adjusting device, a second position in which the switch means closes the power source to make operative the machine controller and the amplitude adjusting device, and a third position in which the switch means produces an operation mode changing signal, and electrical circuit means receiving the operation mode changing signal and operative to electrically connect the amplitude adjusting device to the machine controller.

* * * * *